US010553341B2

(12) United States Patent
Otsubo et al.

(10) Patent No.: US 10,553,341 B2
(45) Date of Patent: Feb. 4, 2020

(54) COIL COMPONENT AND MODULE INCLUDING THE SAME

(71) Applicant: Murata Manufacturing Co., Ltd., Kyoto (JP)

(72) Inventors: Yoshihito Otsubo, Kyoto (JP); Norio Sakai, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 708 days.

(21) Appl. No.: 15/351,622

(22) Filed: Nov. 15, 2016

(65) Prior Publication Data

US 2017/0062113 A1 Mar. 2, 2017

Related U.S. Application Data

(63) Continuation of application No. PCT/JP2015/061683, filed on Apr. 16, 2015.

(30) Foreign Application Priority Data

May 20, 2014 (JP) ..... 2014-104013

(51) Int. Cl.
*H01F 17/06* (2006.01)
*H01F 27/29* (2006.01)

(52) U.S. Cl.
CPC ..... *H01F 17/062* (2013.01); *H01F 27/292* (2013.01); *H01F 2027/297* (2013.01)

(58) Field of Classification Search
CPC . H01F 17/062; H01F 27/292; H01F 2027/297
USPC ..... 336/200, 232
See application file for complete search history.

(56) References Cited

U.S. PATENT DOCUMENTS 6,188,305 B1 * 2/2001 Chang ..... H01F 17/0033 336/200
2009/0002111 A1 * 1/2009 Harrison ..... H01F 19/04 336/69
2015/0061817 A1 * 3/2015 Lee ..... H01F 17/0013 336/221

FOREIGN PATENT DOCUMENTS

JP S64-8710 U 1/1989
JP H01-318220 A 12/1989
JP 3009805 U 4/1995
(Continued)

OTHER PUBLICATIONS

International Search Report issued in Patent Application No. PCT/JP2015/061683 dated Jun. 9, 2015.
(Continued)

*Primary Examiner* — Tszfung J Chan
(74) *Attorney, Agent, or Firm* — Pearne & Gordon LLP

(57) ABSTRACT

An improvement in coil characteristics is achieved by performing accurate positioning of a magnetic core. A coil component 2 includes a wiring substrate 3, a magnetic core 4 that has a ring-like shape and that is disposed on a bottom surface of the wiring board 3, and a coil electrode 5 that is wound around the magnetic core 4, and the coil electrode 5 includes a plurality of inner metallic pins 11*a* and outer metallic pins 11*b* that are vertically arranged around the magnetic core 4. First end portions of the plurality of inner and outer metallic pins 11*a* and 11*b* are each connected, with solder, to an end surface of a corresponding one of a plurality of via conductors 9*a*, the end surface being exposed at the bottom surface of the wiring board 3.

20 Claims, 6 Drawing Sheets

(56) References Cited

FOREIGN PATENT DOCUMENTS

| | | | |
|---|---|---|---|
| JP | 2006-278841 | A | 10/2006 |
| JP | 2010-516056 | A | 5/2010 |

OTHER PUBLICATIONS

Written Opinion issued in Patent Application No. PCT/JP2015/061683 dated Jun. 9, 2015.

* cited by examiner

COIL COMPONENT AND MODULE INCLUDING THE SAME

This is a continuation of International Application No. PCT/JP2015/061683 filed on Apr. 16, 2015 which claims priority from Japanese Patent Application No. 2014-104013 filed on May 20, 2014. The contents of these applications are incorporated herein by reference in their entireties.

FIELD OF THE DISCLOSURE

The present disclosure relates to a coil component that includes a magnetic core disposed on a substrate and a coil electrode wound around the magnetic core and to a module that includes the coil component.

DESCRIPTION OF THE RELATED ART

Coil components have been widely used as components for suppressing noise in modules that handle high-frequency signals. For example, as illustrated in FIG. 10, a coil component 100 described in Patent Document 1 includes a substrate 101 made of an insulating resin and a ring-shaped magnetic core 102 mounted on a top surface of the substrate 101. In addition, a coil electrode wound around the magnetic core 102 in a helical manner is formed of a plurality of wiring-electrode patterns 103, which are formed on the substrate 101, and a plurality of jumpers 104, which are formed of flat wires each of which is bent so as to have a U shape, the jumpers 104 being arranged so as to extend across the magnetic core 102.

Patent Document 1: Japanese Unexamined Patent Application Publication No. 2006-278841 ([0010] to [0014], FIG. 1, and the like)

BRIEF SUMMARY OF THE DISCLOSURE

Along with the recent reduction in the size of electronic devices, there have been demands for a reduction in the size of coil components and for higher performance of coil components. Accordingly, for example, achieving a reduction in the size of a coil component by arranging a magnetic core and a coil electrode so as to be close to each other and achieving an improvement in the inductance of a coil component by increasing the number of turns of a coil electrode may be considered. However, in the coil component 100 of the related art, it is difficult to perform accurate positioning of the magnetic core 102 and the coil electrode (jumpers 104) relative to each other. Consequently, in a design in which the gap between the magnetic core 102 and the coil electrode is set to be small, there is a possibility that the coil electrode (jumpers 104) will come into contact with the magnetic core 102. When the coil electrode (jumpers 104) comes into contact with the magnetic core 102, stress is applied to the magnetic core 102, which in turn leads to deterioration of coil characteristics. In addition, since the jumpers 104, which are portions of the coil electrode, are each formed by bending a flat metal plate into a U shape, it is also difficult to increase the number of turns of the coil electrode by reducing the gaps between the jumpers 104.

The present disclosure has been made in view of the above-described problems, and it is an object of the present disclosure to provide a coil component having excellent coil characteristics by performing accurate positioning of a coil core.

To achieve the above-described object, a coil component according to the present disclosure includes a substrate, a coil core disposed on one of main surfaces of the substrate, and a coil electrode that is wound around the coil core. The coil electrode includes a plurality of metallic pins each of which has a first end portion connected, with solder, to one of a plurality of mount electrodes formed in the one main surface of the substrate, the plurality of metallic pins being vertically arranged around the coil core. The plurality of metallic pins include a plurality of metallic positioning pins. Support portions, each of which is formed of solder in a fillet-like shape, are provided between peripheral surfaces of the first end portions of the metallic positioning pins and the corresponding mount electrodes. The coil core is positioned as a result of an end edge of the coil core being in contact with outer peripheral surfaces of the support portions.

In this case, the coil core is positioned as a result of the end edge of the coil core being in contact with the outer peripheral surfaces of the support portions, each of which is formed of solder in a fillet-like shape and which are formed between the peripheral surfaces of the first end portions of the plurality of metallic positioning pins included in the coil electrode and the corresponding mount electrodes. Thus, positioning of the metallic pins included in the coil electrode and the coil core relative to each other can be accurately performed.

By accurately performing the positioning of the coil core, the coil core and the metallic pins can be prevented from unnecessarily coming into contact with each other and from coming close to each other, and thus, the metallic pins can be prevented from being displaced or falling down as a result of the coil core coming into contact with the metallic pins. In addition, as a result of the metallic pins and the coil core being accurately positioned relative to each other, a very small gap can be maintained without the metallic pins and the coil core coming into contact with each other. In this case, a reduction in undesirable parasitic inductance can be achieved by reducing the entire length of the coil electrode, and thus, coil characteristics of the coil component are improved. Furthermore, by reducing the gaps between the coil core and the metallic pins, a reduction in the size of the coil component can be facilitated.

Since the coil core is positioned (supported) by being in contact with the outer peripheral surfaces of the support portions, each of which has a fillet-like shape and which are formed between the peripheral surfaces of the first end portions of the metallic positioning pins and the corresponding mount electrodes, even in the case where the metallic pins and the coil core come into contact with each other, stress that is received by the coil core from the metallic pins can be reduced.

In addition, in the case of the metallic pins, since the gaps between the adjacent metallic pins can easily be reduced, an improvement in the inductance of the coil component can be achieved by increasing the number of turns of the coil electrode.

The coil core may have a ring-like shape, and the metallic pins may include a plurality of inner metallic pins arranged along an inner peripheral surface of the coil core and a plurality of outer metallic pins arranged along an outer peripheral surface of the coil core. In addition, among the inner and outer metallic pins, the inner and outer metallic pins that are arranged in a diametrical direction of the coil core when viewed in plan view are included in the metallic positioning pins. In the case where the coil core is a so-called toroidal coil having a ring-like shape, positioning of the coil core can be performed with certainty by causing the inner and outer metallic pins that are arranged in the diametrical direction of the coil core when viewed in plan view to function as the metallic positioning pins.

The coil core may have a ring-like shape, and the metallic pins may include a plurality of inner metallic pins arranged along an inner peripheral surface of the coil core and a plurality of outer metallic pins arranged along an outer peripheral surface of the coil core. In the case where the inner metallic pins are divided into three inner blocks in a circumferential direction of the coil core, each of the inner blocks has at least one of the inner metallic pins that are included in an inner metallic pin group. Further, where the outer metallic pins are divided into three outer blocks in the circumferential direction of the coil core, each of the outer blocks has at least one of the outer metallic pins that are included in an outer metallic pin group, the metallic positioning pins may include at least one of the inner metallic pins included in the inner metallic pin group and at least one of the outer metallic pins included in the outer metallic pin group.

In the case where the coil core is a toroidal coil having a ring-like shape, the coil core is supported by solder fillets (support portions) of the three metallic pins on either the outer periphery side or the inner periphery side of the coil core by causing at least one of the metallic pins included in the inner metallic pin group or the outer metallic pin group to function as the metallic positioning pins. The inner metallic pin group includes at least one of the inner metallic pins in each of the inner blocks, and the outer metallic pin group includes at least one of the metallic pins in each of the outer blocks. Thus, positioning of the coil core can be performed with improved certainty.

The metallic positioning pins may be positioned so as to be closer to the coil core than the metallic pins, which are not included in the metallic positioning pins, are. With this configuration, the support portions, each of which is formed of solder in a fillet-like shape and which are formed between the first end portions of the metallic positioning pins and the corresponding mount electrodes can be brought close to the coil core. Thus, accurate positioning of the coil core can easily be performed.

The area of each of the mount electrodes that are connected to the metallic positioning pins may be larger than the area of each of the other mount electrodes that are connected to the metallic pins, which are not included in the metallic positioning pins. With this configuration, each of solder fillets (the support portions) of the metallic positioning pin can be formed so as to be larger than each of solder fillets of the metallic pins, which are not included in the metallic positioning pins. Thus, accurate positioning of the coil core can easily be performed.

A surface of the coil core may be coated with an insulating coating film. With this configuration, insulation between the coil core and the metallic pins can be maintained. Thus, deterioration of the coil characteristics due to electrical connection between the coil core and the metallic pins as a result of the coil core and the metallic pins being in contact with each other can be suppressed.

The coil component may further include a support insulating layer that is provided so as to be interposed between the one main surface of the substrate and the coil core and that supports the coil core. In the configuration in which positioning of the coil core is performed by bringing the end edge of the coil core into contact with the outer peripheral surfaces of the support portions of the metallic positioning pins, stress generated by the weight of the coil core and the like is concentrated at portions where the coil core is in contact with the support portions. Thus, there is a possibility that the insulating coating film, with which the surface of the coil core is coated, will tear at the above-mentioned portions where the coil core is in contact with the support portions. Accordingly, by providing the support insulating layer such that the support insulating layer is interposed between the substrate and the coil core, positioning of the coil core can be performed by using the solder fillets while the coil core is supported by the support insulating layer, and the insulating coating film can be prevented from being torn.

A module may be formed of the above-described coil component and an electronic component that is mounted on at least one of the main surfaces of the substrate of the coil component. In this case, a module that includes a coil component having excellent coil characteristics can be provided.

According to the present disclosure, the coil core is positioned as a result of the end edge of the coil core being in contact with the outer peripheral surfaces of the support portions, each of which is formed of solder in a fillet-like shape and which are formed between the peripheral surfaces of the first end portions of the plurality of metallic positioning pin included in the coil electrode and the corresponding mount electrodes. Thus, positioning of the metallic pins included in the coil electrode and the coil core relative to each other can be accurately performed.

DETAILED DESCRIPTION OF THE DISCLOSURE

First Embodiment

Figure 1:
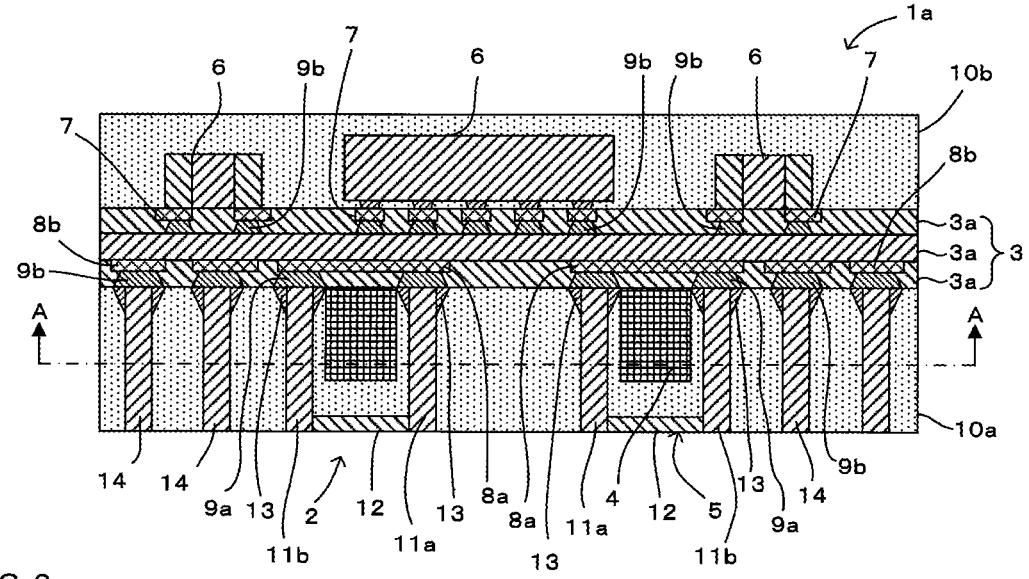
FIG. 1 is a sectional view of a module according to a first embodiment of the present disclosure.
Figure 2:
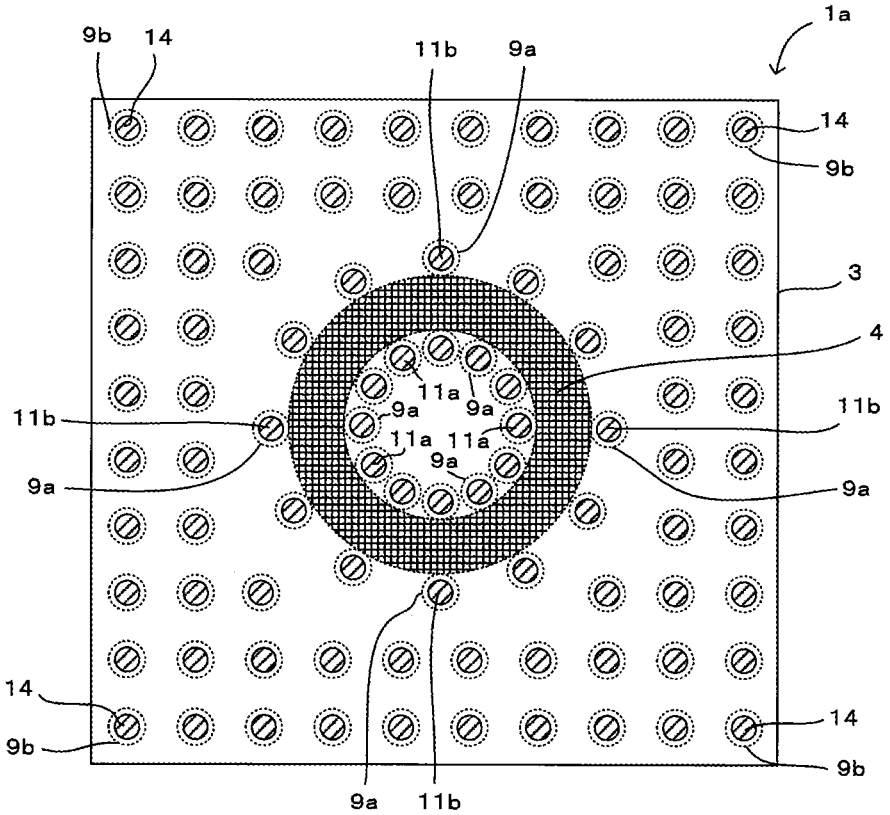
FIG. 2 is a cross-sectional view taken along line A-A of FIG. 1.

A module 1*a* according to a first embodiment of the present disclosure will be described with reference to FIG. 1 and FIG. 2. FIG. 1 is a sectional view of the module 1*a*, and FIG. 2 is a cross-sectional view taken along line A-A of FIG. 1.

As illustrated in FIG. 1, the module 1*a* according to the present embodiment includes a coil component 2, electronic components 6, and sealing-resin layers 10*a* and 10*b*. The coil component 2 includes a wiring substrate 3 (corresponding to a substrate according to the present disclosure), a magnetic core (corresponding to a coil core according to the present disclosure) that is disposed on a bottom surface of the wiring board 3 (corresponding to a first main surface of the substrate according to the present disclosure), and a coil electrode 5 that is wound around the magnetic core 4. The electronic components 6 are mounted on a top surface of the wiring substrate 3. The sealing-resin layer 10*a* and the sealing-resin layer 10*b* are respectively formed on the bottom surface and the top surface of the wiring substrate 3.

The wiring substrate 3 is a multilayer body formed of a plurality of insulating layers 3*a* each of which is made of a glass epoxy resin, a low-temperature co-fired ceramic, or the like. A plurality of connecting electrodes 7 used for mounting the electronic components 6 are formed on the top surface of the wiring substrate 3, and various wiring electrodes 8*a* and 8*b* and a plurality of via conductors 9*a* and 9*b* are formed in the wiring substrate 3. In this case, the various wiring electrodes 8*a* and 8*b* and the connecting electrodes 7 are each made of a common electrode material, such as Cu, Ag, or Al. Each of the via conductors 9*a* and 9*b* is each made of Cu, Ag, or the like. Note that nickel plating and gold plating may be performed on a surface of each of the connecting electrodes 7. The wiring substrate 3 may have a single-layer structure.

Each of the electronic components 6 is formed of a semiconductor device, which is made of Si, GaAs, or the like, a chip component, such as a chip capacitor, a chip inductor, or a chip resistor, or the like. The electronic components 6 are mounted on the wiring substrate 3 by using a commonly known surface mount technology.

The magnetic core 4 is made of a magnetic material, such as Mn—Zn ferrite, that is employed as a common coil core. Note that the magnetic core 4 according to the present embodiment has a ring-like shape and is used as a core of a toroidal coil.

The coil electrode 5 is wound around the ring-shaped magnetic core 4 in a helical manner and includes a plurality of metallic pins 11*a* and 11*b* each of which is positioned around the magnetic core 4 in a state of being vertically arranged on the bottom surface of the wiring board 3. Each of the metallic pins 11*a* and 11*b* is made of a metallic material, such as Cu, Au, Ag, or an Al-based or a Cu-based alloy, that is generally employed as a wiring electrode. Each of the metallic pins 11*a* and 11*b* can be formed by, for example, shearing a metallic line member made of one of the above-mentioned metallic materials. Note that, although the term "vertically arranged" refers to the case where each of the metallic pins 11*a* and 11*b* is disposed in an upright position, the axis (the lengthwise direction) of each of the metallic pins 11*a* and 11*b* is not necessarily parallel to a direction perpendicular to the bottom surface of the wiring substrate, and the metallic pins 11*a* and 11*b* may be obliquely arranged.

As illustrated in FIG. 2, the metallic pins 11*a* and 11*b* include the plurality of inner metallic pins 11*a*, which are arranged along the inner peripheral surface of the magnetic core 4, and the plurality of outer metallic pins 11*b*, which are arranged along the outer peripheral surface of the magnetic core 4 so as to be paired with the corresponding inner metallic pins 11*a*. Lower end surfaces of the via conductors 9*a* and 9*b*, which are formed on the side on which the bottom surface of the wiring board 3 is present, are exposed at the bottom surface of the wiring board 3, and first end portions of the inner and outer metallic pins 11*a* and 11*b* are connected to the lower end surfaces of the corresponding via conductors 9*a* with solder. The lower end surfaces of the via conductors 9*a*, which are connected to the corresponding inner and outer metallic pins 11*a* and 11*b*, correspond to mount electrodes according to the present disclosure.

The first end portions of the pairs of the inner and outer metallic pins 11*a* and 11*b* are each connected via the corresponding via conductor 9*a* to a corresponding one of the wiring electrodes 8*a*, which is formed in the wiring substrate 3. A second end portion of each of the inner metallic pins 11*a* is connected, by one of wiring-electrode patterns 12 formed in a surface of the sealing-resin layer 10*a* (the surface being opposite to a surface of the sealing-resin layer 10*a* that is in contact with the wiring substrate 3), to a second end portion of one of the outer metallic pins 11*b*, one of the outer metallic pins 11*b* being adjacent to, on one side (in a clockwise direction, for example), another one of the outer metallic pins 11*b* that is paired with the inner metallic pin 11*a*. With a connecting structure such as that described above that is formed of the metallic pins 11*a* and 11*b*, the wiring electrodes 8*a*, the via conductors 9*a*, and the wiring-electrode patterns 12, the coil electrode 5, which is wound around the ring-shaped magnetic core 4 in a helical manner, is formed. Note that the wiring-electrode patterns 12, which connect the second end portions of the inner metallic pins 11*a* and the corresponding second end portions of the outer metals 11*b* to each other, can be formed, for example, on the surface of the sealing-resin layer 11*a* by using a printing technique using a conductive paste containing a metal, such as Cu or Ag. Alternatively, instead of each of the wiring-electrode patterns 12, a bonding wire made of a metal, such as Au or Al, may be used.

In the present embodiment, all the inner metallic pins 11*a* and all the outer metallic pins 11*b* function as metallic positioning pins used for positioning of the magnetic core 4. More specifically, support portions 13, each of which is formed of solder in a fillet-like shape, are provided between peripheral surfaces of the first end portions of the inner and outer metallic pins 11*a* and 11*b* and the lower end surfaces of the corresponding via conductors 9*a*, and the magnetic core 4 is positioned as a result of an end edge of the magnetic core 4 being in contact with outer peripheral surfaces of the support portions 13. In other words, when the metallic pins 11*a* and 11*b* are connected to the lower end surfaces of the corresponding via conductors 9*a* with solder, solder fillets are formed at portions at which the metallic pins 11*a* and 11*b* are connected to the lower end surfaces of the corresponding via conductors 9*a*, and these solder fillets function as the support portions 13, so that the magnetic core 4 is positioned. Note that, although the magnetic core 4 is positioned in a state of being in contact with the bottom surface of the wiring board 3 in the present embodiment, the magnetic core 4 may be positioned by being in contact with the support portions 13 while being in a floating state with respect to the bottom surface of the wiring board 3. In this case, the magnetic core 4 can be disposed so as to be closer to the inner metallic pins 11*a* and the outer metallic pins while the magnetic core 4 is not in contact with the inner metallic pins 11*a* and the outer metallic pins.

A plurality of external-connection metallic pins 14 that are used for connecting the module 1*a* to an external mother substrate or the like are provided on the bottom surface of the wiring board 3. The external-connection metallic pins 14 are located outside the outer metallic pins 11*b* while being vertically arranged on the bottom surface of the wiring board 3. Each of the external-connection metallic pins 14 is disposed such that a first end portion of the external-connection metallic pin 14 is connected to the end surface (the end surface that is exposed at the bottom surface of the wiring board 3) of a corresponding one of the via conductors 9*b* with solder and that an end surface of a second end portion of the external-connection metallic pin 14 is exposed at the surface of the sealing-resin layer 10*a*, so that the external-connection metallic pin 14 can be connected to the outside at the end surface of the second end portion thereof.

The sealing-resin layer 10*a* on the bottom surface of the wiring board 3 is provided so as to cover the bottom surface of the wiring board 3, the metallic pins 11*a*, 11*b*, and 14, and the magnetic core 4, and the sealing-resin layer 10*b* on the top surface of the wiring board 3 is provided so as to cover the top surface of the wiring substrate 3 and the electronic components 6. Note that both the sealing-resin layers 10*a* and 10*b* can be formed by using, for example, various materials, such as an epoxy resin, that are generally employed as sealing materials for the electronic components 6.

(Method for Manufacturing Module)

An example of a method for manufacturing the module 1*a* will now be described. First, the wiring substrate 3 in which the wiring electrodes 8*a* and 8*b*, the via conductors 9*a* and 9*b*, and the connecting electrodes 7 have been formed is prepared. In this case, for example, the via conductors 9*a* and 9*b* can be formed by forming via holes at predetermined positions in one of the insulating layers 3*a* by using a laser or the like and by injecting a conductive paste containing a metal, such as Cu or Ag, into the via holes such that the via holes are filled with the conductive paste by using a printing technique or the like. The wiring electrodes 8*a* and 8*b* and the connecting electrodes 7 can also be formed in main surfaces of the corresponding insulating layers 3*a* by using, for example, a printing technique using a conductive paste containing a metal, such as Cu or Ag. The via conductors 9*a* and 9*b*, which are positioned at the bottom surface of the wiring board 3, are formed such that the lower end surfaces of the via conductors 9*a* and 9*b* are exposed at the bottom surface of the wiring board 3.

Next, after the electronic components 6 have been mounted on the top surface of the wiring substrate 3 by using a commonly known surface mount technology, the sealing-resin layer 10*b* is formed on the top surface of the wiring substrate 3 by using a sealing resin, such as an epoxy resin, so as to cover the electronic components 6 and the top surface of the wiring substrate 3. Note that the sealing-resin layer 10*b* can be formed by using, for example, an application method, a printing method, a compression molding method, a transfer molding method, or the like.

Next, the inner metallic pins 11*a*, the outer metallic pins 11*b*, and the external-connection metallic pins 14 are mounted, with solder, onto the corresponding lower end surfaces of the via conductors 9*a* and 9*b* exposed at the bottom surface of the wiring board 3. In this case, the support portions 13, each of which is formed of solder in a fillet-like shape, are formed between the peripheral surfaces of the first end portions of the inner and outer metallic pins 11*a* and 11*b* and the lower end surfaces of the corresponding via conductors 9*a*.

Next, the magnetic core 4, which has a ring-like shape, is disposed in a region between the inner metallic pins 11*a* and the outer metallic pins 11*b*. In this case, the magnetic core 4 is positioned as a result of the end edge of the magnetic core 4 being in contact with the support portions.

Next, in the same manner as the method of forming the sealing-resin layer 10*b* on the top surface of the wiring substrate 3, the sealing-resin layer 10*a* is formed on the bottom surface of the wiring board 3 so as to cover the inner metallic pins 11*a*, the outer metallic pins 11*b*, the magnetic core 4, the external-connection metallic pins 14, and the bottom surface of the wiring board 3.

Next, polishing or grinding is performed on the surface of the sealing-resin layer 10*a* (the surface being opposite to the surface of the sealing-resin layer 10*a* that is in contact with the wiring substrate 3) so as to cause the end surfaces of the second end portions of the metallic pins 11*a*, 11*b*, and 14 to be exposed at the surface of the sealing-resin layer 10*a*. Finally, the plurality of wiring-electrode patterns 12, which connect the end surfaces of the second end portions of the inner metallic pins 11*a* and the end surfaces of the second end portions of the corresponding outer metallic pins to each other, are formed on the surface of the sealing-resin layer 10*a*, so that the module 1*a* is completed. Note that each of the wiring-electrode patterns 12 can be formed by using, for example, a printing technique using a conductive paste containing a metal, such as Cu or Ag.

According to the above-described embodiment, the magnetic core 4 is positioned as a result of the end edge of the magnetic core 4 being in contact with the outer peripheral surfaces of the support portions 13, each of which is formed of solder in a fillet-like shape and which are formed between the peripheral surfaces of the first end portions of the inner and outer metallic pins 11*a* and 11*b* (metallic positioning pins) included in the coil electrode 5 and the lower end surfaces (mount electrodes) of the via conductors 9*a*. Therefore, positioning of the metallic pins 11*a* and 11*b* of the coil electrode 5 and the magnetic core 4 relative to each other can be accurately performed.

In addition, by accurately performing the positioning of the metallic pins 11*a* and 11*b* and the magnetic core 4 relative to each other, the magnetic core 4 and the metallic pins 11*a* and 11*b* can be prevented from unnecessarily coming into contact with each other and from coming close to each other, and thus, the metallic pins 11*a* and 11*b* can be prevented from being displaced or falling down as a result of the magnetic core 4 coming into contact with the metallic pins 11*a* and 11*b*. Furthermore, as a result of the metallic pins 11*a* and 11*b* and the magnetic core 4 being accurately positioned relative to each other, a very small gap can easily be maintained without the metallic pins 11*a* and 11*b* and the magnetic core 4 coming into contact with each other. Consequently, a reduction in undesirable parasitic inductance can be achieved by reducing the entire length of the coil electrode 5. Therefore, the coil characteristics of the coil component 2 can be improved, and the module 1*a*, which includes the coil component 2 having excellent coil characteristics, can be provided. In addition, by reducing the gaps between the magnetic core 4 and the metallic pins 11*a* and 11*b*, a reduction in the size of the coil component 2 and the size of the module 1*a* can be facilitated.

Since the magnetic core 4 is positioned (supported) by being in contact with the outer peripheral surfaces of the support portions 13 of the metallic pins 11*a* and 11*b*, even in the case where the metallic pins 11*a* and 11*b* and the magnetic core 4 come into contact with each other, stress that is received by the magnetic core 4 from the metallic pins 11*a* and 11*b* can be reduced. In addition, as a result of the stress being reduced, deterioration of the coil characteristics (variations in inductance and the like) that occurs when the magnetic core 4 receives an external stress can be reduced.

Regarding the metallic pins 11*a* and 11*b*, since the gaps between the adjacent metallic pins 11*a* and 11*b* can easily be reduced, the number of turns of the coil electrode 5 can easily be increased by including the metallic pins 11*a* and 11*b* in the coil electrode 5. Thus, an improvement in the inductance of the module 1*a* (coil component 2) can easily be achieved. In addition, since each of the metallic pins 11*a* and 11*b* has specific resistance smaller than that of a via conductor made of a conductive paste, the coil characteristics can be improved, whereas if the coil electrode 5 includes via conductors instead of the metallic pins 11*a* and 11*b*, the coil characteristics would not be improved.

Since all the metallic pins 11*a* and 11*b*, which are included in the coil electrode 5, function as the metallic positioning pins used for positioning of the magnetic core 4, positioning of the magnetic core 4 can be performed with certainty. In addition, since each of the above-mentioned support portions 13 each having a fillet-like shape has a predetermined inclined surface, there is a low risk of contact between the magnetic core 4 and the metallic pins 11*a* and 11*b* when positioning the magnetic core 4, and the above-mentioned positioning can be performed with a specific degree of certainty.

Second Embodiment

Figure 3:
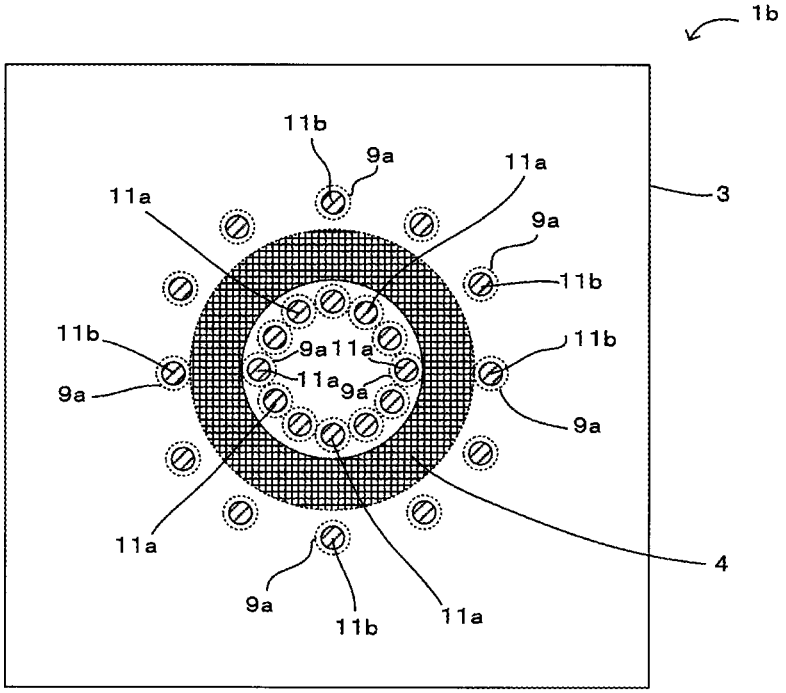
FIG. 3 is a diagram illustrating the arrangement of metallic positioning pins of a module according to a second embodiment of the present disclosure.

A module 1*b* according to a second embodiment of the present disclosure will now be described with reference to FIG. 3. FIG. 3 is a diagram illustrating the arrangement of metallic positioning pins of the module 1*b* and is a diagram that corresponds to FIG. 2. In FIG. 3, the external-connection metallic pins 14 are not illustrated.

The difference between the module 1*b* according to the present embodiment and the module 1*a* according to the first embodiment, which has been described with reference to FIG. 1 and FIG. 2, is the arrangement of the metallic positioning pins as illustrated in FIG. 3. Since the rest of the configuration of the module 1*b* is the same as that of the module 1*a* according to the first embodiment, the same reference numerals will be used, and description thereof will be omitted.

In this case, as illustrated in FIG. 3, the metallic positioning pins include only some of the inner metallic pins 11*a* and the outer metallic pins 11*b*, some of the inner metallic pins 11*a* and the outer metallic pins 11*b* being arranged in a diametrical direction of the magnetic core 4 when viewed in plan view. In the present embodiment, the metallic positioning pins include four metallic pins among the metallic pins 11*a* and 11*b*, the four metallic pins including two inner metallic pins 11*a* positioned at the left and right ends in FIG. 3 and two outer metallic pins 11*b* positioned at the left and right ends in FIG. 3, and these four metallic pins 11*a* and 11*b* are arranged in the diametrical direction of the magnetic core 4 when viewed in plan view. The metallic positioning pins are positioned so as to be closer to the magnetic core 4 than the other metallic pins 11*a* and 11*b* are, and the magnetic core 4 is positioned as a result of the end edge of the magnetic core 4 being in contact with the support portions 13 of the metallic positioning pins. As described above, instead of causing all the inner and outer metallic pins 11*a* and 11*b* to function as the metallic positioning pins, for example, only some of the inner metallic pins 11*a* and the outer metallic pins 11*b*, some of the inner metallic pins 11*a* and the outer metallic pins 11*b* being arranged in a line in a diametrical direction of the magnetic core 4, may be included in the metallic positioning pins.

In the case where the magnetic core 4 is a toroidal coil having a ring-like shape, by causing some of the inner metallic pins 11*a* and the outer metallic pins 11*b*, some of the inner metallic pins 11*a* and the outer metallic pins 11*b* being arranged in a diametrical direction of the magnetic core 4 when viewed in plan view, to function as the metallic positioning pins, positioning of the magnetic core 4 can be performed, and advantageous effects similar to those of the module 1*a* according to the first embodiment can be obtained.

In addition, by arranging the metallic positioning pins so as to be closer to the magnetic core 4 than the other metallic pins 11*a* and 11*b* are, the support portions 13 of the metallic positioning pins can be brought close to the magnetic core 4, and thus, accurate positioning of the magnetic core 4 can easily be performed.

Third Embodiment

Figure 4:
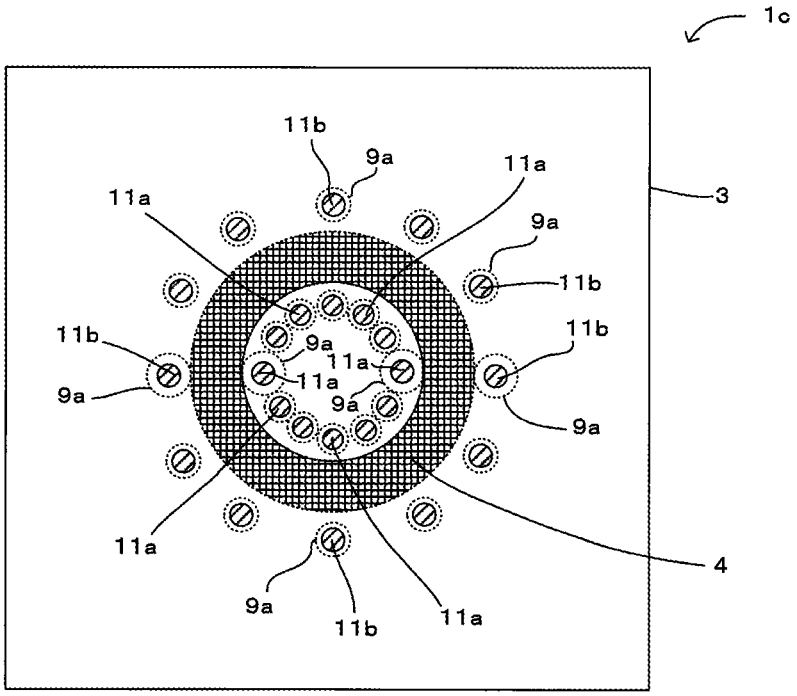
FIG. 4 is a diagram illustrating the arrangement of metallic positioning pins of a module according to a third embodiment of the present disclosure.

A module 1*c* according to a third embodiment of the present disclosure will now be described with reference to FIG. 4. FIG. 4 is a diagram illustrating the arrangement of metallic positioning pins of the module 1*c* and is a diagram that corresponds to FIG. 2. In FIG. 4, the external-connection metallic pins 14 are not illustrated.

The difference between the module 1*c* according to the present embodiment and the module 1*b* according to the second embodiment, which has been described with reference to FIG. 3, is that some of the via conductors 9*a*, some of the via conductors 9*a* being to be connected to the metallic positioning pins, are formed such that the lower end surfaces (mount electrodes) thereof each have an area larger than the area of each of the lower end surfaces of the other via conductors 9*a* that are connected to the metallic pins 11*a* and 11*b*, which are not included in the metallic positioning pins, as illustrated in FIG. 4. Since the rest of the configuration of the module 1*c* is the same as that of the module 1*b* according to the second embodiment, the same reference numerals will be used, and description thereof will be omitted.

In this case, two of the via conductors 9*a* that are connected to the outer metallic pins 11*b* (metallic positioning pins) positioned at the left and right ends, and another two of the via conductors 9*a* that are connected to the inner metallic pins 11*a* (metallic positioning pins) positioned at the left and right ends are formed such that the lower end surface (mount electrode) of each of these four via conductors 9*a* has an area larger than the area of each of the lower end surfaces of the other via conductors 9*a* that are connected to the inner and outer metallic pins 11*a* and 11*b* that are not the above-mentioned outer and inner metallic pins 11*b* and 11*a*.

With this configuration, each of the support portions 13 of the metallic positioning pins can be formed so as to be larger than each of the solder fillets that are formed of solder between the peripheral surfaces of the first end portions of the metallic pins 11*a* and 11*b*, which are not included in the metallic positioning pins, and the lower end surfaces of the corresponding via conductors 9*a*, and thus, accurate positioning of the magnetic core 4 can easily be performed.

Fourth Embodiment

Figure 5:
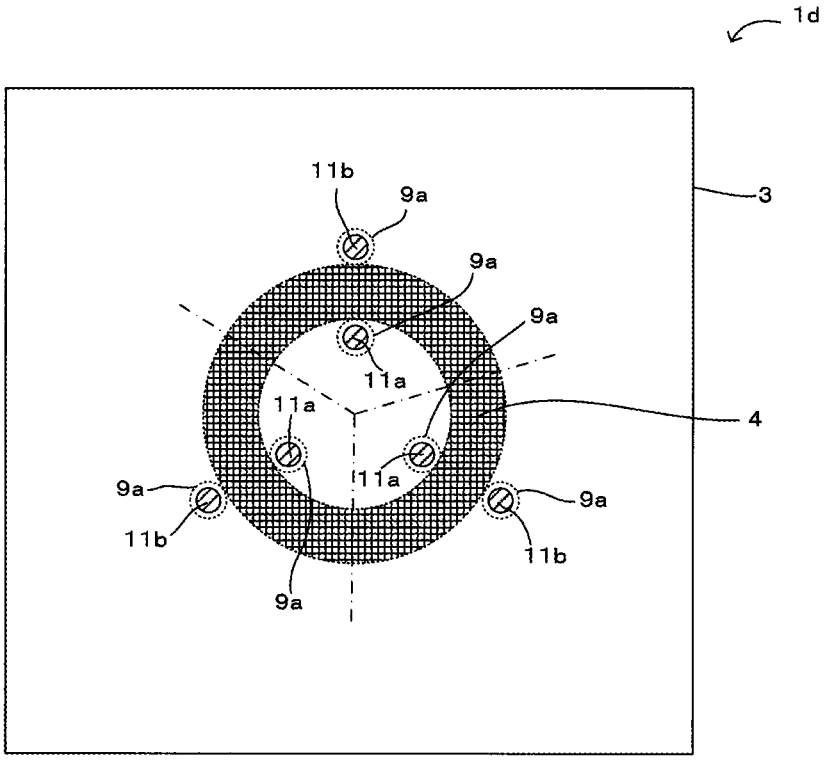
FIG. 5 is a diagram illustrating the arrangement of metallic positioning pins of a module according to a fourth embodiment of the present disclosure.

A module 1*d* according to a fourth embodiment of the present disclosure will now be described with reference to FIG. 5. FIG. 5 is a diagram illustrating the arrangement of metallic positioning pins of the module 1*d* and is a diagram that corresponds to FIG. 2. In FIG. 5, the external-connection metallic pins 14 are not illustrated. The inner metallic pins 11*a* and the outer metallic pins 11*b* that are not included in the metallic positioning pins are also not illustrated.

The difference between the module 1*c* according to the present embodiment and the module 1*a* according to the first embodiment, which has been described with reference to FIG. 1 and FIG. 2, is the arrangement of the metallic positioning pins as illustrated in FIG. 5. Since the rest of the configuration of the module 1*d* is the same as that of the module 1*a* according to the first embodiment, the same reference numerals will be used, and description thereof will be omitted.

In this case, as illustrated in FIG. 5, the metallic positioning pins include six metallic pins among the metallic pins 11*a* and 11*b*, the six metallic pins including three inner metallic pins 11*a* arranged at a pitch of approximately 120 degrees and three outer metallic pins 11*b* arranged at a pitch of approximately 120 degrees. The magnetic core 4 is positioned as a result of the end edge of the magnetic core 4 being in contact with the support portions 13 of the six metallic pins 11*a* and 11*b*. Note that the metallic positioning pins may include one of the above-mentioned three inner metallic pins 11*a* and one of the above-mentioned three outer metallic pins 11*b*.

In the case of the magnetic core 4 having a ring-like shape, even if an arrangement of the metallic positioning pins such as that described above is employed, positioning of the magnetic core 4 can be performed with certainty. Note that the above-described arrangement of the metallic positioning pins can be suitably changed. In other words, the metallic positioning pins may include at least one of the metallic pins 11*a* that are included in an inner metallic pin group and at least one of the metallic pins 11*b* that are included in an outer metallic pin group. Regarding the inner metallic pin group, when the inner metallic pins 11*a* are divided into three blocks (inner blocks) (e.g., three blocks indicated by one dot chain lines in FIG. 5) in the circumferential direction of the magnetic core 4, each of the inner blocks has at least one of the inner metallic pins 11*a* included in the inner metallic pin group. Regarding the outer metallic pin group, when the outer metallic pins 11*b* are divided into three blocks (outer blocks) in the circumferential direction of the magnetic core 4, each of the outer blocks has at least one of the outer metallic pins 11*b* included in the outer metallic pin group.

Fifth Embodiment

Figure 6:
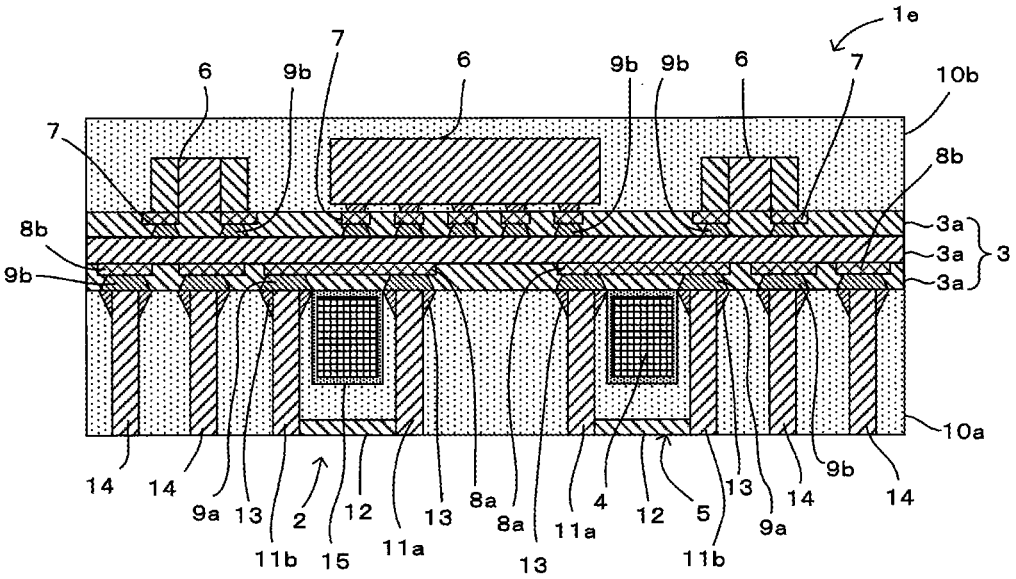
FIG. 6 is a cross-sectional view of a module according to a fifth embodiment of the present disclosure.

A module 1*e* according to a fifth embodiment of the present disclosure will now be described with reference to FIG. 6. FIG. 6 is a cross-sectional view of the module 1*e*.

The difference between the module 1*e* according to the present embodiment and the module 1*a* according to the first embodiment, which has been described with reference to FIG. 1 and FIG. 2, is that a surface of the magnetic core 4 is coated with an insulating coating film 15 as illustrated in FIG. 6. Since the rest of the configuration of the module 1*e* is the same as that of the module 1*a* according to the first embodiment, the same reference numerals will be used, and description thereof will be omitted.

In this case, the insulating coating film 15 is made of an insulating resin, such as a silicon-based resin, and the magnetic core 4 is positioned as a result of the end edge of the magnetic core 4 that is coated with the insulating coating film 15 being in contact with the support portions 13 of the metallic positioning pins. In addition, the magnetic core 4 coated with the insulating coating film 15 is disposed in a state of being in contact with the bottom surface of the wiring board 3.

With this configuration, for example, even in the case where the specific resistance of the magnetic core 4 is small, such as in the case where the magnetic core 4 is made of a Mn—Zn ferrite material, insulation between the magnetic core 4 and the metallic pins 11*a* and 11*b* can be maintained, and thus, deterioration of the coil characteristics due to electrical connection between the magnetic core 4 and the metallic pins 11*a* and 11*b* as a result of the magnetic core 4 and the metallic pins 11*a* and 11*b* being in contact with each other can be suppressed. In addition, in the case where the insulating coating film 15 is made of a silicon resin, the insulating coating film 15 functions as a stress-reducing member when an external stress is applied to the magnetic core 4, and thus, deterioration of the coil characteristics due to the external stress applied to the magnetic core 4 can be suppressed.

Sixth Embodiment

Figure 7:
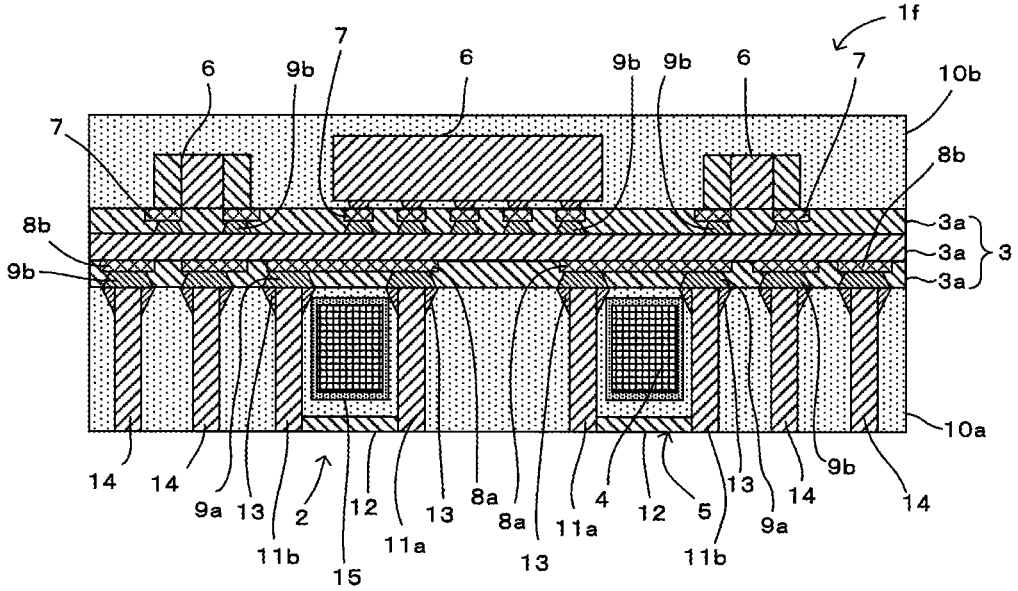
FIG. 7 is a cross-sectional view of a module according to a sixth embodiment of the present disclosure.

A module 1*f* according to a sixth embodiment of the present disclosure will now be described with reference to FIG. 7. FIG. 7 is a cross-sectional view of the module 1*f*.

The difference between the module 1*f* according to the present embodiment and the module 1*e* according to the fifth embodiment, which has been described with reference to FIG. 6, is that the magnetic core 4 coated with the insulating coating film 15 is disposed in a floating state with respect to the bottom surface of the wiring board 3 as illustrated in FIG. 7. Since the rest of the configuration of the module 1*f* is the same as that of the module 1*e* according to the fifth embodiment, the same reference numerals will be used, and description thereof will be omitted.

In this case, the magnetic core 4 coated with the insulating coating film 15 is positioned as a result of the end edge of the magnetic core 4 being in contact with the support portions 13 of the metallic positioning pins while the magnetic core 4 is in a floating state with respect to the bottom surface of the wiring board 3. With this configuration, the magnetic core 4 coated with the insulating coating film 15 and the metallic pins 11*a* and 11*b* can be arranged so as to be close to each other while maintaining the insulation between the magnetic core 4 and the metallic pins 11*a* and 11*b*.

Seventh Embodiment

Figure 8:
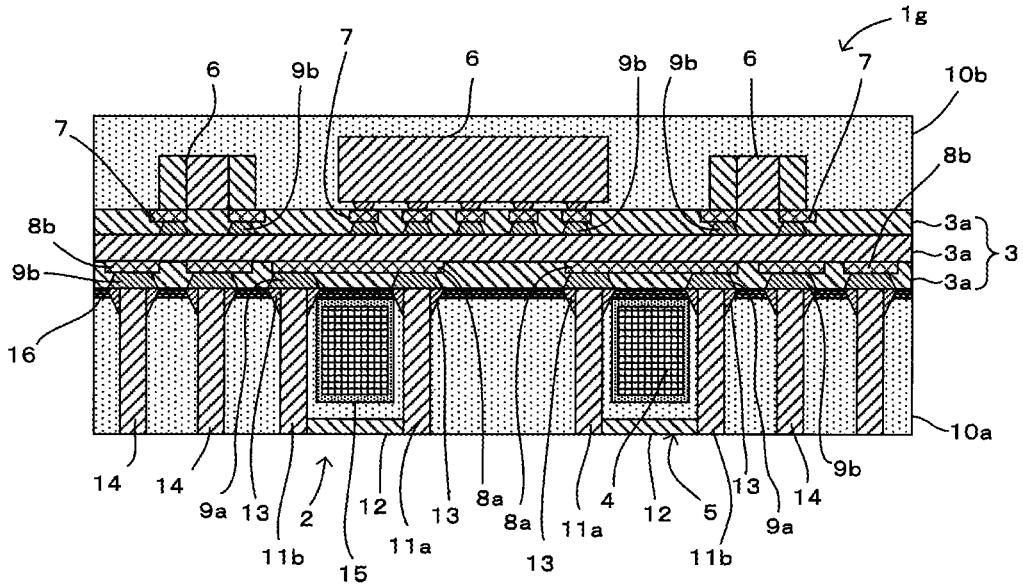
FIG. 8 is a cross-sectional view of a module according to a seventh embodiment of the present disclosure.

A module 1*g* according to a seventh embodiment of the present disclosure will now be described with reference to FIG. 8. FIG. 8 is a cross-sectional view of the module 1*g*.

The difference between the module 1*g* according to the present embodiment and the module 1*f* according to the sixth embodiment, which has been described with reference to FIG. 7, is that a support insulating layer 16 that supports the magnetic core 4 coated with the insulating coating film 15 is provided between the bottom surface of the wiring board 3 and the magnetic core 4, whose surface is coated with the insulating coating film 15, as illustrated in FIG. 8. Since the rest of the configuration of the module 1*g* is the same as that of the module 1*f* according to the sixth embodiment, the same reference numerals will be used, and description thereof will be omitted.

In this case, the magnetic core 4 coated with the insulating coating film 15 is disposed in a floating state with respect to the bottom surface of the wiring board 3, and the support insulating layer 16 is formed so as to be interposed between the magnetic core 4 and the bottom surface of the wiring board 3. The support insulating layer 16 is formed so as to have such a thickness that the support portions 13 of the metallic positioning pins will not be entirely covered with the support insulating layer 16, and the magnetic core 4 coated with the insulating coating film 15 is disposed so as to be in contact with the support insulating layer 16, so that the magnetic core 4 is supported by the support insulating layer 16. Note that the support insulating layer 16 can be made of, for example, a common material such as an epoxy resin that is employed as an underfill resin.

In the configuration in which positioning of the magnetic core 4 is performed by bringing the end edge of the magnetic core 4 into contact with the outer peripheral surfaces of the support portions 13 of the metallic positioning pins, in the case where the magnetic core 4 is disposed in a floating state with respect to the bottom surface of the wiring board 3, stress generated by the weight of the magnetic core 4 and the like is concentrated at portions where the magnetic core 4 is in contact with the support portions 13 (corner portions of the magnetic core 4). Thus, in the case where the surface of the magnetic core 4 is coated with the insulating coating film 15, there is a possibility that the insulating coating film 15 will tear at the portions where the magnetic core 4 is in contact with the support portions 13. Accordingly, by providing the support insulating layer 16 such that the support insulating layer 16 is interposed between the wiring substrate 3 and the magnetic core 4, the magnetic core 4 can be supported by the support insulating layer 16, and thus, the insulating coating film 15 can be prevented from being torn.

Note that the present disclosure is not limited to the above-described embodiments, and various changes other than those described above can also be made within the scope of the present disclosure. For example, a module may be formed by combining the configurations according to the above-described embodiments with one another.

In addition, in the above-described embodiments, the coil component 2 may be formed as a discrete component without mounting the electronic components 6 onto the top surface of the wiring substrate 3.

Although the case where the inner metallic pins 11*a* and the outer metallic pins 11*b* are directly mounted onto the end surfaces of the corresponding via conductors 9*a* has been described in the above embodiments, additional mount electrodes may be formed on the end surfaces of the via conductors 9*a*, and the metallic pins 11*a* and 11*b* may be connected to these mount electrodes with solder.

Figure 9A:
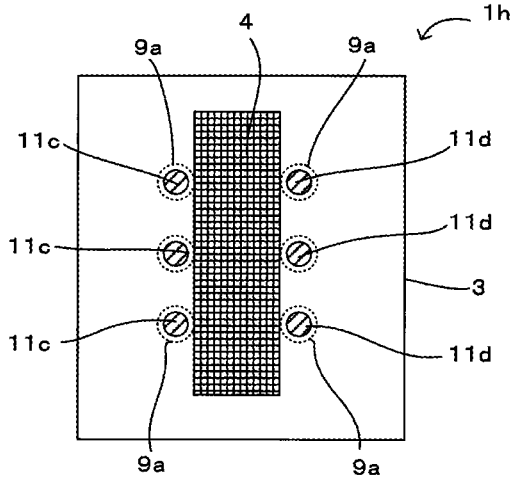
FIGS. 9A and 9B include diagrams each illustrating a modification of a magnetic core.
Figure 9B:
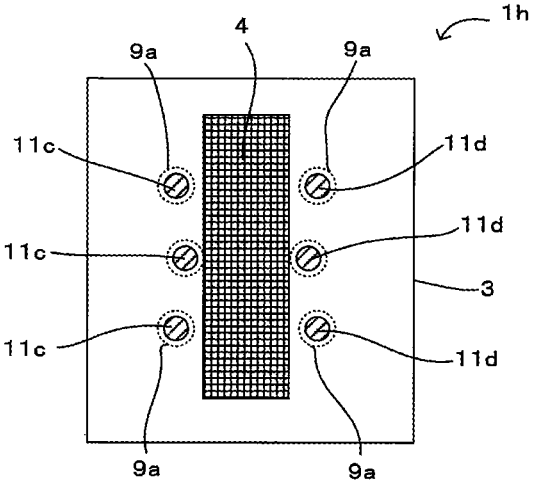
Figure 10:
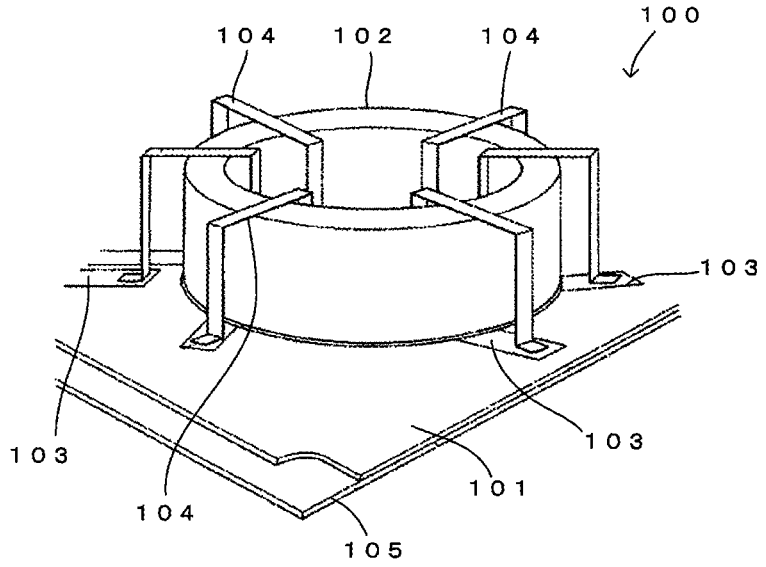
FIG. 10 is a perspective view of a coil component of the related art.

As illustrated in FIGS. 9A and 9B, it is not necessary for the magnetic core 4 to have a ring-like shape, and for example, the magnetic core 4 may be formed in a bar-like shape. FIGS. 9A and 9B include diagrams each illustrating a modification of the magnetic core 4, and the diagrams correspond to FIG. 2. (The external-connection metallic pins 14 are not illustrated.) FIG. 9A illustrates, as an example, the case where all metallic pins 11*c* and 11*d*, which are included in the coil electrode 5, function as metallic positioning pins, and FIG. 9B illustrates, as an example, the case where one pair of metallic pins 11*c* and 11*d* that are facing each other with the magnetic core 4 interposed therebetween function as metallic positioning pins.

The present disclosure can be widely applied to various coil components each of which includes a magnetic core disposed on a substrate and a coil electrode wound around the magnetic core and various modules that include these coil components.

1*a* to 1*h* module
2 coil component
3 wiring substrate (substrate)
4 magnetic core (coil core)
5 coil electrode
6 electronic component
9*a* via conductor (mount electrode)
11*a* inner metallic pin (metallic positioning pin)
11*b* outer metallic pin (metallic positioning pin)
11*c* metallic pin (metallic positioning pin)
11*d* metallic pin (metallic positioning pin)
13 support portion
15 insulating coating film
16 support insulating layer

The invention claimed is:

1. A coil component comprising:
a substrate;
a coil core disposed on one of main surfaces of the substrate; and
a coil electrode wound around the coil core,
wherein the coil electrode includes a plurality of metallic pins each of which has a first end portion connected, with solder, to one of a plurality of mount electrodes located in the one of the main surfaces of the substrate, the plurality of metallic pins being vertically arranged around the coil core,
wherein the plurality of metallic pins include a plurality of metallic positioning pins,
wherein support portions, each of which comprises solder in a fillet-like shape, are provided between peripheral surfaces of the first end portions of the metallic positioning pins and corresponding ones of the mount electrodes, and
wherein the coil core is positioned so that an end edge of the coil core abuts against outer peripheral surfaces of the support portions.

2. The coil component according to claim 1,
wherein the coil core has a ring-like shape,
wherein the metallic pins include a plurality of inner metallic pins arranged along an inner peripheral surface of the coil core and a plurality of outer metallic pins arranged along an outer peripheral surface of the coil core, and
wherein one or more of the inner and outer metallic pins arranged in a diametrical direction of the coil core when viewed in plan view are included in the metallic positioning pins.

3. The coil component according to claim 1,
wherein the coil core has a ring-like shape,
wherein the metallic pins include a plurality of inner metallic pins arranged along an inner peripheral surface of the coil core and a plurality of outer metallic pins arranged along an outer peripheral surface of the coil core,
wherein, when the inner metallic pins are divided into three inner blocks in a circumferential direction of the coil core, each of the inner blocks has at least one of the inner metallic pins included in an inner metallic pin group,
wherein, when the outer metallic pins are divided into three outer blocks in the circumferential direction of the coil core, each of the outer blocks has at least one of the outer metallic pins included in an outer metallic pin group, and
wherein the metallic positioning pins comprise either of the inner metallic pins included in the inner metallic pin group or the outer metallic pins included in the outer metallic pin group.

4. The coil component according to claim 1,
wherein the metallic positioning pins are positioned so as to be closer to the coil core than the metallic pins not included in the metallic positioning pins.

5. The coil component according to claim 1,
wherein an area of each of the mount electrodes connected to the metallic positioning pins is larger than an area of each of another mount electrodes connected to the metallic pins not included in the metallic positioning pins.

6. The coil component according to claim 1, wherein a surface of the coil core is coated with an insulating coating film.

7. The coil component according to claim 1, further comprising:

a support insulating layer provided so as to be interposed between the one main surface of the substrate and the coil core, wherein the support insulating layer supports the coil core.

8. A module comprising:

the coil component according to claim 1, and an electronic component mounted on at least one of the main surfaces of the substrate.

9. The coil component according to claim 2, wherein the metallic positioning pins are positioned so as to be closer to the coil core than the metallic pins not included in the metallic positioning pins.

10. The coil component according to claim 3, wherein the metallic positioning pins are positioned so as to be closer to the coil core than the metallic pins not included in the metallic positioning pins.

11. The coil component according to claim 2, wherein an area of each of the mount electrodes connected to the metallic positioning pins is larger than an area of each of another mount electrodes connected to the metallic pins not included in the metallic positioning pins.

12. The coil component according to claim 3, wherein an area of each of the mount electrodes connected to the metallic positioning pins is larger than an area of each of another mount electrodes connected to the metallic pins not included in the metallic positioning pins.

13. The coil component according to claim 4, wherein an area of each of the mount electrodes connected to the metallic positioning pins is larger than an area of each of another mount electrodes connected to the metallic pins not included in the metallic positioning pins.

14. The coil component according to claim 2, wherein a surface of the coil core is coated with an insulating coating film.

15. The coil component according to claim 3, wherein a surface of the coil core is coated with an insulating coating film.

16. The coil component according to claim 4, wherein a surface of the coil core is coated with an insulating coating film.

17. The coil component according to claim 5, wherein a surface of the coil core is coated with an insulating coating film.

18. The coil component according to claim 2, further comprising:

a support insulating layer provided so as to be interposed between the one main surface of the substrate and the coil core, wherein the support insulating layer supports the coil core.

19. The coil component according to claim 3, further comprising:

a support insulating layer provided so as to be interposed between the one main surface of the substrate and the coil core, wherein the support insulating layer supports the coil core.

20. The coil component according to claim 4, further comprising:

a support insulating layer provided so as to be interposed between the one main surface of the substrate and the coil core, wherein the support insulating layer supports the coil core.

* * * * *